US005498139A

United States Patent [19]

Williams

[11] Patent Number: 5,498,139

[45] Date of Patent: Mar. 12, 1996

[54] BRUSH SEAL

[75] Inventor: Christopher C. Williams, Lake Worth, Fla.

[73] Assignee: United Technologies Corporation, Hartford, Conn.

[21] Appl. No.: 336,890

[22] Filed: Nov. 9, 1994

[51] Int. Cl.[6] ..... F01D 11/02

[52] U.S. Cl. ..... 415/173.70; 415/174.5; 416/244 A; 277/9; 277/53

[58] Field of Search ..... 415/173.5, 173.7, 415/174.2, 174.5, 173.3, 196, 230; 416/244 A; 277/9, 53

[56] References Cited

U.S. PATENT DOCUMENTS

| | | | |
|---|---|---|---|
| Re. 30,206 | 2/1980 | Ferguson et al. . | |
| 3,345,035 | 10/1967 | Johnson et al. | 416/244 A |
| 3,356,339 | 12/1967 | Thomas et al. | 416/244 A |
| 4,657,482 | 4/1987 | Neal . | |
| 4,798,481 | 1/1989 | Frank | 277/9 |
| 4,884,850 | 12/1989 | Greer . | |
| 5,031,922 | 7/1991 | Heydrich . | |
| 5,090,710 | 2/1992 | Flower . | |
| 5,106,104 | 4/1992 | Atkinson et al. | 415/174.5 |
| 5,114,159 | 5/1992 | Baird et al. . | |
| 5,135,237 | 8/1992 | Flower . | |
| 5,176,389 | 1/1993 | Noone et al. . | |
| 5,181,728 | 1/1993 | Stee . | |
| 5,192,084 | 3/1993 | Norbury . | |
| 5,201,530 | 4/1993 | Kelch et al. . | |
| 5,265,412 | 11/1993 | Bagepalli et al. . | |
| 5,308,088 | 5/1994 | Atkinson et al. . | |
| 5,310,319 | 5/1994 | Grant et al. . | |
| 5,318,309 | 6/1994 | Tseng et al. . | |
| 5,335,920 | 8/1994 | Tseng et al. . | |
| 5,363,906 | 11/1994 | Borowy | 277/53 |

FOREIGN PATENT DOCUMENTS

| | | | |
|---|---|---|---|
| 3431990A | 3/1986 | Germany . | |
| 59-5807 | 1/1984 | Japan | 415/174.5 |
| 4-347066 | 12/1992 | Japan | 277/53 |
| 257330 | 8/1926 | United Kingdom | 277/53 |
| 492954 | 9/1938 | United Kingdom . | |
| 1598926 | 9/1981 | United Kingdom | 277/53 |

OTHER PUBLICATIONS

"CR Seals Handbook", Jan. 1986, pp. 31–33.

*Primary Examiner*—F. Daniel Lopez
*Assistant Examiner*—James A. Larson
*Attorney, Agent, or Firm*—Richard D. Getz

[57] ABSTRACT

A brush seal for an apparatus having a stationary member and a rotating member is provided comprising a seal element and a seal ring. The seal element includes a plurality of bristles and is attached to one of the stationary or rotating members. The seal ring is detachably attached to the other of the stationary or rotating members, aligned with the seal element. The seal ring may be readily detached from the stationary or rotating member and may be replaced in the event of mechanical damage to the seal ring by the seal element. The seal ring isolates the stationary or rotating member, to which the seal ring is attached, from mechanical damage caused by the seal element.

12 Claims, 2 Drawing Sheets

BRUSH SEAL

The invention was made under a U.S. Government contract and the Government has fights herein.

BACKGROUND OF THE INVENTION

1. Technical Field

This invention pertains to seals in general and to brush seals in particular.

2. Background Information

Brush seals comprising a plurality of bristles sandwiched between a facing plate and a backing plate may be used to prevent or inhibit fluid flow from a higher pressure region to a lower pressure region. Typically, the brush seal seals the gap between a stationary member and a rotating member where the higher pressure region exists on one side of the members and the low pressure region on the other side. The seal is attached to either the stationary or the rotating member with its bristles extending across the gap therebetween. The bristles are usually positioned out of contact with the sealing surface section of the other of the stationary or rotating member under ambient conditions. Under higher temperatures, the bristles may contact the sealing surface section of the other of the stationary or rotating member if sufficient thermal expansion has occurred. Moreover, under extreme thermal conditions it is possible for the backing plate of the seal to thermally expand and contact the sealing surface. In all cases, contact between the seal and the sealing surface can cause undesirable wear and may even necessitate replacement of the stationary or rotating member having the sealing surface.

DISCLOSURE OF THE INVENTION

It is, therefore, an object of the present invention to provide a brush seal which minimizes the possible extent of damage to either the stationary or rotating member due to thermal expansion.

It is another object of the present invention to provide a brush seal that facilitates maintenance.

It is still another object of the present invention to provide a brush seal that minimizes maintenance cost.

According to the present invention, a brush seal for an apparatus having a stationary member and a rotating member is provided comprising a seal element and a seal ring. The seal element includes a plurality of bristles and is attached to one of the stationary or rotating members. The seal ring is detachably attached to the other of the stationary or rotating members, aligned with the seal element. The seal ring may be readily detached from the stationary or rotating member and may be replaced in the event of mechanical damage to the seal ring by the seal element. The seal ring isolates the stationary or rotating member, to which the seal ring is attached, from mechanical damage caused by the seal element.

According to one aspect of the present invention, the seal ring comprises a body, a first shoulder, and a second shoulder. The shoulders prevent axial displacement of the seal ring relative to the stationary or rotating member after attachment of the seal ring to that member.

According to another aspect of the present invention, means for detaching the seal ring without damage to the member to which the seal ring is attached is provided.

An advantage of the present invention is that the seal ring minimizes the possible extent of damage to either the stationary or rotating member due to thermal expansion. If, for example, the seal element were to thermally expand and contact the seal ring attached to the rotating member, the seal ring could be replaced rather than the rotating member. Hence, any damage that did occur would be borne by the seal ring rather than by the rotating member.

Another advantage of the present invention is that the seal element and seal ring facilitate maintenance. Depending upon the application of the brush seal, it may be advantageous to have the seal element contact the seal ring. In that event, the seal ring would be subject to frictional wear. Using the present invention, it is possible to replace the seal ring as necessary rather than resurfacing or replacing the rotating member (or stationary member—whichever the seal element is not attached to).

Another advantage of the present invention is that the seal element and seal ring minimize maintenance cost. The cost of replacing a major component in an apparatus can be daunting, depending upon the apparatus. The brush seal arrangement of the present invention permits the replacement of the wear items as necessary, rather than the stationary or rotating pieces to which they are attached.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
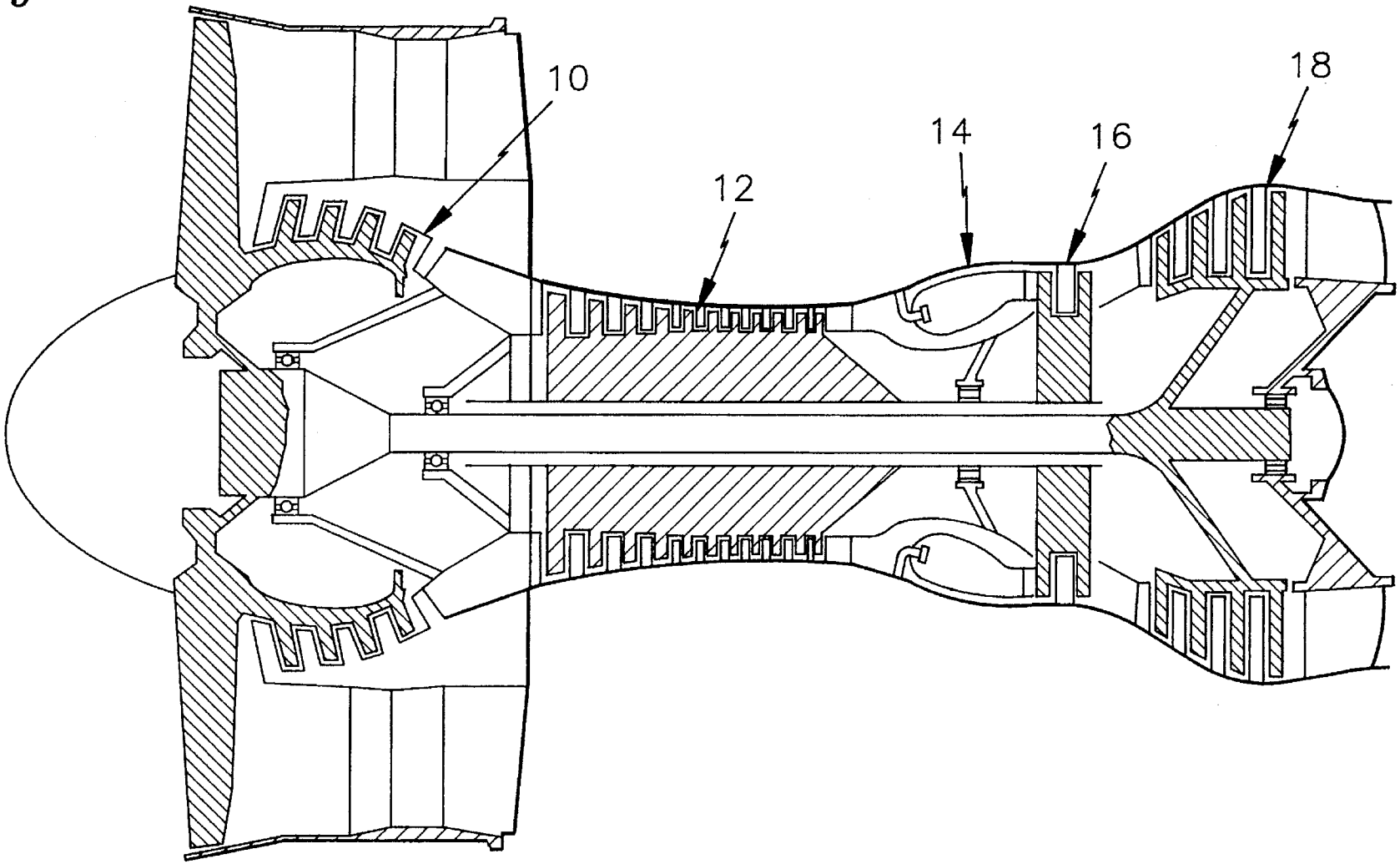
FIG. 1 shows a diagrammatic sectional view of a gas turbine engine.

Referring to FIG. 1, a gas turbine engine may be described as comprising a low pressure compressor 10, a high pressure compressor 12, a combustor section 14, a high pressure turbine 16, and a low pressure turbine 18. Gases compressed in the compressor sections 10,12 are mixed with fuel and burned in the combustor section 14. The resultant gases, at a higher temperature and pressure, then enter the turbine sections 16,18 and create pressure regions within the turbine sections 16,18. To optimize the work done by the engine it is necessary to position seals at specific points in the compressor sections 10,12 and turbine sections 16,18 to maintain discrete pressure zones.

Figure 2:
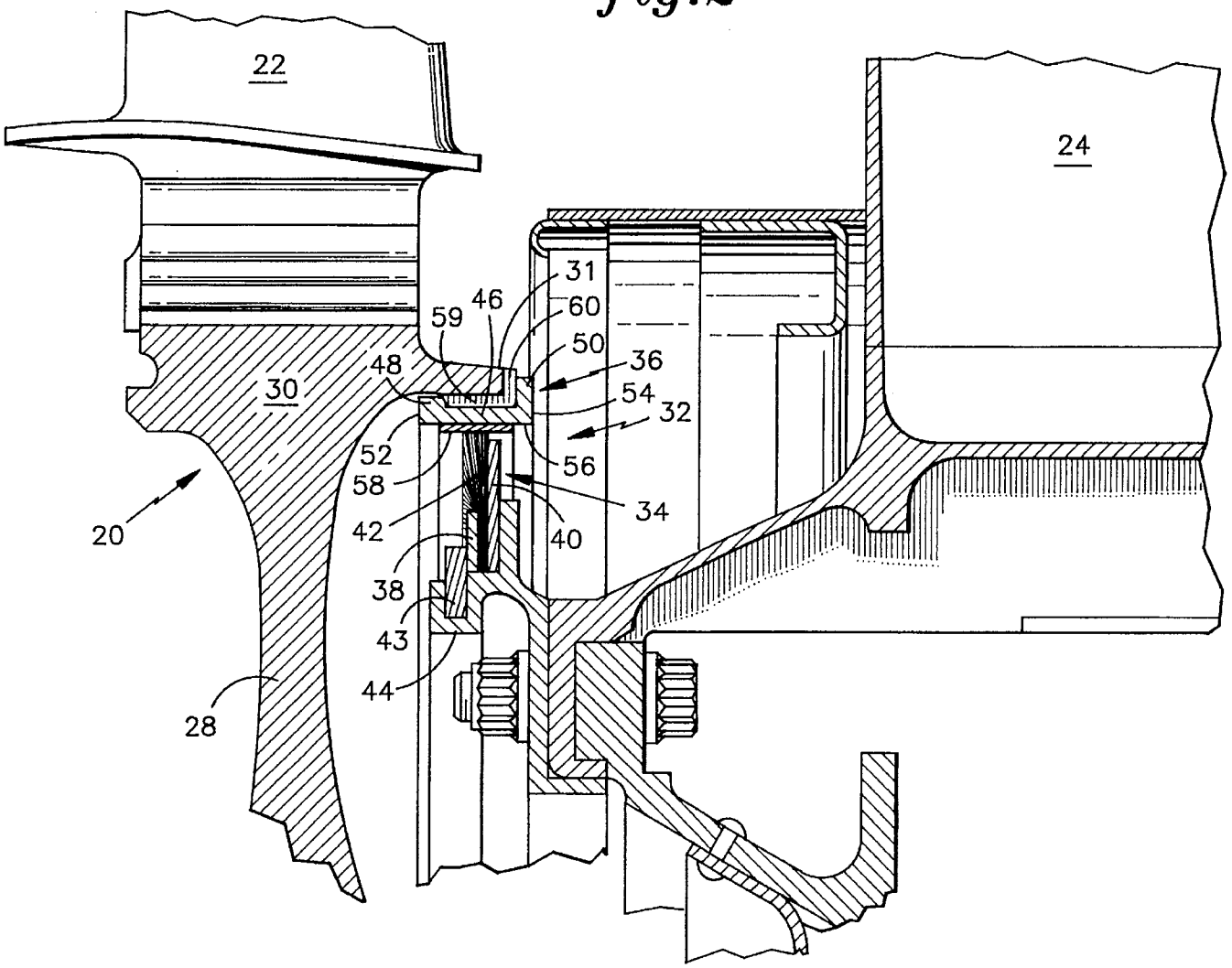
FIG. 2 shows a diagrammatic sectional view of a turbine disc and blade and a stationary vane.

Referring to FIG. 2, the turbines 16,18 may be described as comprising a plurality of turbines discs 20, turbine blades 22, and stationary vanes 24 in a spaced apart configuration relative to one another. Each turbine disc 20 includes a body having a web 28 extending radially outward, a head 30 formed at the radial extreme of the web 28, and a land 31 extending axially out from the head 30.

A brush seal 32 seals the passage between a stationary vane 24 and a rotating turbine disc 20. The brush seal 32 comprises a seal element 34 and a seal ring 36. The seal element 34 includes a facing plate 38, a backing plate 40, and a plurality of bristles 42. The bristles 42 are fixed between the two plates 38,40 by welding or other conventional means. A retaining ring 43 attaches the seal element 34 to a seal support ring 44, which in turn positions the seal element 34 in close proximity to the seal ring 36. The seal support ring 44 is attached to the stationary vane 24 by conventional means.

The seal ring 36 comprises a body 46, a first shoulder 48, and a second shoulder 50. The body 46 includes an inner edge 52, an outer edge 54, and a sealing surface 56. The first shoulder 48 extends radially outward adjacent the inner edge 52 and the second shoulder 50 extends radially outward adjacent the outer edge 54. The outer diameter of the second shoulder 50 is greater than that of the first shoulder 48. In one embodiment, a coating 58 having a hardness greater than that of the seal ring 36 is attached to the sealing surface 56.

To facilitate removal of seal ring 36 without damaging the turbine disc land 31, the land 31 includes a first relief 59 in the inner radial surface of the land 31 and a second relief 60 aligned in the outer axial surface of the land 31. The reliefs 59,60 provide space for the seal ring 36 to be cut away, and thereby removed, without damaging the land 31. A second set of reliefs (not shown) may be positioned 180° away to permit the seal ring to be removed in halves. Relief configurations other than that described heretofore may be used alternatively. Indeed, depending upon the application it may be advantageous to place the relief(s) in the seal ring 36 rather than the member to which it is attached. Conventional fasteners may also be used to secure the seal ring 36. A person of skill in the art will recognize that the manner of attachment and removal of the seal ring is a distinct advantage, for the reason that they minimize the opportunities for damage to the turbine disc.

In the assembly of the brush seal 32, the turbine disc 20 is heated to thermally expand the inner diameter of the land 31. At the same time the seal ring 36 may be cooled to shrink the outer diameters of the seal ring 36. The seal ring 36 is then slid into place, or "received" within the turbine disc land 31. After cooling, the seal ring 36 is held in place by a diametral interference fit between the land 31 and the seal ring 36. The first 48 and second 50 shoulders of the seal ring 36, which form a male and female pair with the land 31 after assembly, prevent the seal ring 36 from moving axially relative to the land 31. After the entire engine is assembled, the seal ring 36 and the seal element 34 are axially aligned with one another.

The best mode of the present invention as described heretofore has been described in terms of a gas turbine engine, and more specifically in terms of a brush seal 32 employed between a turbine disc 20 and a stationary vane 24. It should be noted that the present invention is applicable to other applications where brush seals may be used and should not be limited to the best mode example given herein.

Although this invention has been shown and described with respect to the detailed embodiments thereof, it will be understood by those skilled in the art that various changes in form and detail thereof may be made without departing from the spirit and scope of the claimed invention.

I claim:

1. A brush seal for an apparatus having a stationary member and a rotating member, comprising:

a seal element, having a plurality of bristles, said seal element attached to one of the stationary or rotating members; and a seal ring, detachably attached to the other of the stationary or rotating members, aligned with said seal element, said seal ring including a body, having a first edge, a second edge, and a seal surface;

a first shoulder, extending radially outward adjacent said first edge; and a second shoulder, extending radially outward adjacent said second edge;

wherein said shoulders prevent axial displacement of said seal ring relative to the stationary or rotating member to which said seal ring is attached after attachment of said seal ring;

wherein said seal ring may be readily detached from the stationary or rotating member and replaced in the event of mechanical damage to said seal ring; and wherein said seal ring isolates the stationary or rotating member to which said seal ring is attached from mechanical damage caused by said seal element.

2. A brush seal according to claim 1, wherein said seal ring is attached to one of the rotating or stationary member by an interference fit.

3. A brush seal according to claim 2, further comprising:

a relief in the one of the rotating or stationary member to which said seal ring is attached to permit the removal of said seal ring without damage to the member.

4. A gas turbine engine, comprising:

a compressor section;

a combustor section; and a turbine section, which includes at least one stationary vane, rotating turbine disc, and brush seal, said brush seal including a seal element, having a plurality of bristles, said seal element attached to said stationary vane;

a seal ring, detachably attached to said turbine disc, and aligned with said seal element, said seal ring including a body, having an first edge, a second edge, and a seal surface;

a first shoulder, extending radially outward adjacent said first edge; and a second shoulder, extending radially outward adjacent said second edge;

wherein said shoulders prevent axial displacement of said seal ring relative to said turbine disc after attachment of said seal ring; and wherein said seal ring may be readily detached from said turbine disc and replaced in the event of mechanical damage to said ring; and wherein said seal ring isolates said turbine disc from mechanical damage caused by said seal element.

5. A gas turbine engine according to claim 4, wherein said seal ring is attached to said turbine disc by an interference fit.

6. A gas turbine engine according to claim 5, further comprising:

a relief in said turbine disc to permit the removal of said seal ring without damage to said turbine disc.

7. A method for preventing mechanical damage by a brush seal in an apparatus having a stationary member and a rotating member, comprising the steps of:

providing a seal element, having a plurality of bristles;

providing a seal ring, said seal ring including a body, having a first edge, a second edge, and a seal surface;

a first shoulder, extending radially outward adjacent said first edge; and a second shoulder, extending radially outward adjacent said second edge;

wherein said shoulders prevent axial displacement of said seal ring relative to the stationary or rotating member to which said seal ring is attached after attachment of said seal ring;

attaching said seal element to one of the stationary or rotating members;

detachably attaching said seal ring to the other of the stationary or rotating members, aligned with said seal element;

wherein said seal ring may be readily detached from the stationary or rotating member and replaced in the event of mechanical damage to said seal ring; and wherein said seal ring isolates the stationary or rotating member to which said ring is attached from mechanical damage caused by said seal element.

8. A method for preventing mechanical damage according to claim 7, wherein said seal ring is attached to one of the rotating or stationary member by an interference fit.

9. A method for preventing mechanical damage according to claim 8, wherein the rotating or stationary member to which said seal ring is attached comprises:

a relief, to permit the removal of said seal ring without damage to the member.

10. A turbine disc for a gas turbine engine, comprising:

a body, having an outer radial surface;

a head, attached to said outer radial surface;

a land, extending out from said head, said land having a first relief formed in an inner radial surface and a second relief formed in an outer axial surface; and a seal ring;

wherein said seal ring is detachably attached to said land; and wherein said reliefs facilitate the detachment of said seal ring.

11. A turbine disc according to claim 10, wherein said seal ring further comprises:

a body, having a first edge, a second edge, and a seal surface;

a first shoulder, extending radially outward adjacent said first edge; and a second shoulder, extending radially outward adjacent said second edge;

wherein said shoulders prevent axial displacement of said seal ring relative to said land after attachment of said seal ring.

12. A seal ring comprising:

a body, having an first edge, a second edge, and a seal surface;

a first shoulder, extending radially outward adjacent said first edge; and a second shoulder, extending radially outward adjacent said second edge;

wherein said shoulders prevent a body received between said shoulders from axially displacing relative to said seal ring.

* * * * *